US007657043B2

(12) United States Patent
Wada et al.

(10) Patent No.: US 7,657,043 B2
(45) Date of Patent: Feb. 2, 2010

(54) ELECTRO-OPTICAL DEVICE AND ELECTRONIC APPARATUS

(75) Inventors: Hiroshi Wada, Horigane-mura (JP); Hisanori Kawakami, Matsumoto (JP); Akio Kobayashi, Shinjiri (JP)

(73) Assignee: Seiko Epson Corporation (JP)

( * ) Notice: Subject to any disclaimer, the term of this patent is extended or adjusted under 35 U.S.C. 154(b) by 1081 days.

(21) Appl. No.: 10/953,877

(22) Filed: Sep. 29, 2004

(65) Prior Publication Data

US 2005/0111678 A1 May 26, 2005

(30) Foreign Application Priority Data

Sep. 30, 2003 (JP) ..... 2003-340322
Aug. 17, 2004 (JP) ..... 2004-237069

(51) Int. Cl.
*H04R 25/00* (2006.01)

(52) U.S. Cl. ..... 381/152; 381/333; 381/388

(58) Field of Classification Search ..... 381/332–334, 381/190, 152, 388
See application file for complete search history.

(56) References Cited

U.S. PATENT DOCUMENTS 6,427,017 B1 7/2002 Toki
7,263,196 B2 * 8/2007 Aubauer et al. ..... 381/332

FOREIGN PATENT DOCUMENTS

CN 1217520 5/1999
CN 1444372 9/2003
GB 2 386 281 9/2003
JP 56-073382 6/1981
JP 11-142820 5/1999
JP 2000-152385 5/2000
JP 2002-077346 3/2002
JP 2003-128073 5/2003
JP 2001-168963 6/2004

OTHER PUBLICATIONS

Communication from Korean Patent Office regarding counterpart application.
Communication from Chinese Patent Office regarding counterpart application.

* cited by examiner

*Primary Examiner*—Suhan Ni
(74) *Attorney, Agent, or Firm*—Harness, Dickey & Pierce, P.L.C.

(57) ABSTRACT

An electro-optical device with a sound generating body is disclosed, in which an electro-optical device and a sound generating body can be mounted compactly and which can eliminate necessity of acoustic design of the sound generating body for an enclosure of an electronic apparatus for accommodating the electro-optical device. The electro-optical device of the present invention includes a first frame, a second frame opposed to the first frame, a third frame interposed between the first frame and the second frame, an electro-optical panel supported by the first frame, and a sound generating body supported by the second frame and covered by the second frame and the third frame, the sound generating body being arranged so as to be two-dimensionally overlapped the electro-optical panel.

6 Claims, 11 Drawing Sheets

ELECTRO-OPTICAL DEVICE AND ELECTRONIC APPARATUS

RELATED APPLICATIONS

This application claims priority to Japanese Patent Application Nos. 2003-340322 filed Sep. 30, 2003, and 2004-237069 filed Aug. 17, 2004 which are hereby expressly incorporated by reference herein in their entirety.

BACKGROUND

1. Field of the Invention

The present invention relates to an electro-optical device and an electronic apparatus and, more specifically, to a structure of an electro-optical device with a sound generating body suitable for mounting on a mobile-type electronic apparatus.

2. Description of Related Art

In general, an electro-optical device is mounted on various types of electronic apparatus as a display body, and in many cases, it is mounted within the electronic apparatus together with a sound generating body such as a speaker. Generally, in the electronic apparatus in the related art, the electro-optical device (for example, a liquid crystal display device) is stored in an enclosure in a state of being apart from the sound generating body. For example, in the case of a mobile-type electronic apparatus such as a mobile phone, the electro-optical device and the sound generating body are separately mounted to substrates arranged within the enclosure (for example, see JP-A-2001-168963), or the electro-optical device and the sound generating body are directly fixed to separate portions within the enclosure (for example, see JP-A-2002-77346).

However, in recent years, downsizing of the mobile-type electronic apparatus and upsizing of the display surface of the display body are in progress. Therefore, with the structure in the related art, if a display unit and a sound generating unit are disposed one on another, the thickness of the enclosure is inevitably increased and, if attempt is made to avoid increase in thickness of the enclosure, it is necessary to dispose the display unit and the sound generating unit so as to avoid overlapping, and hence upsizing of the apparatus cannot be inevitable.

When installing the sound generating body within the electronic apparatus, since it is necessary to perform acoustic design around the sound generating body for each enclosure, pursuit of enclosure design is limited, and hence reduction in size or thickness of the enclosure cannot be achieved satisfactorily.

SUMMARY

In order to solve the aforementioned problem, it is an object of the present invention to provide an electro-optical device with a sound generating body, in which the electro-optical device and the sound generating body can be mounted compactly. Also, it is another object to provide an electro-optical device with a sound generating body, which can eliminate necessity of acoustic design of the sound generating body for an enclosure of an electronic apparatus for accommodating the electro-optical device.

An electro-optical device of the present invention includes a first frame, a second frame opposed to the first frame, a third frame interposed between the first frame and the second frame, an electro-optical panel supported by the first frame, and a sound generating body supported by the second frame and covered by the second frame and the third frame, the sound generating body being arranged so as to be two-dimensionally overlapped the electro-optical panel.

According to the invention, since the third frame is interposed between the first frame and the second frame, the electro-optical panel is supported by the first frame, the sound generating body is supported by the second frame and covered by the second frame and the third frame, and the electro-optical panel and the sound generating body are overlapped two-dimensionally, the electro-optical device provided with a sound generating function can be integrally configured, whereby the entire device can be formed compactly. Also, it is possible to facilitate manufacture such as assembly while securing functions of supporting the electro-optical panel, supporting the sound generating body, and integrating the electro-optical panel and the sound generating body by the first frame, the second frame, and the third frame.

In the present invention, preferably, the first frame is a panel holding frame that holds the electro-optical panel, the third frame is a sound generating frame that defines an air chamber of the sound generating body, and the second frame is fixed to the first frame. In this arrangement, the electro-optical panel is positioned and the third frame can be fixed in a state of being interposed between the first frame and the second frame by holding the electro-optical panel by the first frame, and fixing the second frame to the first frame. Also, since the sound generating air chamber can be defined by the sound generating frame, which corresponds to the third frame, it can be configured in such a manner that an acoustic effect of the sound generating body is substantially determined by the structure of the electro-optical device, and, consequently, necessity of performing acoustic design of the sound generating body by mounting equipment or the like may be avoided. A detailed example of this structure is stated in the first and the third embodiments described later.

An electro-optical device of the present invention includes a first frame, a second frame opposed to the first frame, a third frame interposed between the first frame and the second frame, an electro-optical panel supported by the third frame, and a sound generating body supported by the second frame and covered by the second frame and the third frame, the sound generating body being arranged so as to be two-dimensionally overlapped the electro-optical panel.

According to the invention, since the third frame is interposed between the first frame and the second frame, the electro-optical panel is supported by the third frame, the sound generating body is supported by the second frame and covered by the second frame and the third frame, and the electro-optical panel and the sound generating body are overlapped two-dimensionally, the electro-optical device provided with a sound generating function can be integrally configured, whereby the entire device can be formed compactly. Also, it is possible to facilitate manufacture such as assembly while fixing functions of supporting the electro-optical panel, supporting the sound generating body, and integrating the electro-optical panel and the sound generating body by the first frame, the second frame, and the third frame.

In the present invention, preferably, the first frame includes an opening, which enables the electro-optical panel to be viewed, the third frame is a panel holding frame that holds the electro-optical panel, and the second frame is fixed to the first frame. In this arrangement, since the third frame, which corresponds to the panel holding frame, can be clamped between the first frame and the second frame, the electro-optical panel and the panel holding frame can be protected by the first frame while maintaining a compact feature. A detailed description of this configuration is stated in the second embodiment shown below.

In the present invention, preferably, the first frame includes an opening, which enables the electro-optical panel to be viewed, the third frame is a panel holding frame that holds the electro-optical panel, and the second frame is fixed to the third frame. In this arrangement, the third frame, which corresponds to the panel holding frame, and the second frame are fixed, and hence the electro-optical panel and a sound generating body are integrated, thereby being protected by the first frame. A detailed description of this configuration is stated in the third embodiment to the seventh embodiment.

In the present invention, preferably, the sound generating body is supported by the second frame via a supporting member, and includes a first surface on the side of the third frame and a second surface on the side of the second frame, the supporting member separates a space between the first surface of the sound generating body and the third frame from a space between the second surface of the sound generating body and the second frame. In this arrangement, since the space on the side of the first surface of the sound generating body and the space on the side of the second surface are separated by the supporting member, effective release of sounds is achieved by opening one of these spaces by means of sound releasing port or the like.

Another electro-optical device according to the present invention includes an electro-optical panel, a panel holding frame that supports the electro-optical panel, a storage frame opposed to the panel holding frame and fixed to the panel holding frame, and a sound generating body supported by the storage frame and covered by the panel holding frame and the storage frame, the sound generating body being disposed so as to overlap the electro-optical panel two-dimensionally.

According to the invention, since the panel holding frame that holds the electro-optical panel and the storage frame that supports the sound generating body are fixed, the sound generating body is covered by the panel holding frame and the storage frame, and the electro-optical panel and the sound generating body are overlapped two-dimensionally, the electro-optical device provided with a sound generating function can be configured integrally, whereby the entire device can be formed compactly. Also, with the provision of the panel holding frame and the storage frame, it is possible to facilitate manufacture such as assembly while securing functions of supporting the electro-optical panel, supporting the sound generating body, and integrating the electro-optical panel and the sound generating body.

In the present invention, preferably, a cover frame fixed to the panel holding frame and disposed so as to clamp the panel holding frame with the storage frame is provided. In this arrangement, since the cover frame is fixed to the panel holding frame, and the panel holding frame is disposed so as to be interposed between the cover frame and the storage frame, the electro-optical panel and the panel holding frame can be protected by the cover frame while maintaining the compact feature. A detailed description of this configuration is stated in the fourth embodiment to the seventh embodiment described later.

In the present invention, preferably, the storage frame and the cover frame include projections and depressions formed in the direction of thickness of the panel holding frame respectively so as to be fixed in a state in which the projections and depressions engage with respect to each other. In this arrangement, since the storage frame and the cover frame fixed in a state in which the projections and depressions engages with respect to each other, rigidity of the frame structure of the electro-optical device can be increased, and deformation of the frame structure can be reduced.

In the present invention, preferably, the sound generating body is supported by the storage frame via the supporting member, and includes a first surface on the side of the panel holding frame and a second surface on the side of the storage frame, and the supporting member separates a space between the first surface of the sound generating body and the panel holding frame from a space between the second surface of the sound generating body and the storage frame. In this arrangement, since the space on the side of the first surface of the sound generating body and the space on the side of the second surface are separated by the supporting member, effective release of sounds is achieved by opening one of these spaces by means of sound releasing port or the like.

In the present invention, preferably, the storage frame includes a sound releasing port that releases sounds emitted from the sound generating body. In this arrangement, since formation of the sound releasing port on the storage frame eliminates necessity of formation of the sound releasing port on the display unit, the entire device can be formed further compactly.

In the present invention, preferably, the sound generating body is a piezoelectric speaker. The piezoelectric speaker can easily be reduced in thickness, the entire device can be reduced in thickness. The term "piezoelectric speaker" used in this specification represents a speaker including a piezoelectric transducer therein.

An electronic apparatus according to the present invention includes the electro-optical device with a sound generating body, and a control device that controls the electro-optical device with a sound generating body. A mobile-type electronic apparatus which is required to be downsized is specifically efficient as an electronic apparatus to which the present invention is applied. The mobile-type electronic apparatus includes a mobile phone, a mobile information terminal, and an electronic watch.

DETAILED DESCRIPTION

Subsequently, referring to the attached drawings, embodiments of the present invention will be described in detail. The respective embodiments described below are shown simply as examples of the present invention, and the contents of description are not intended to limit the present invention.

First Embodiment

Figure 1:
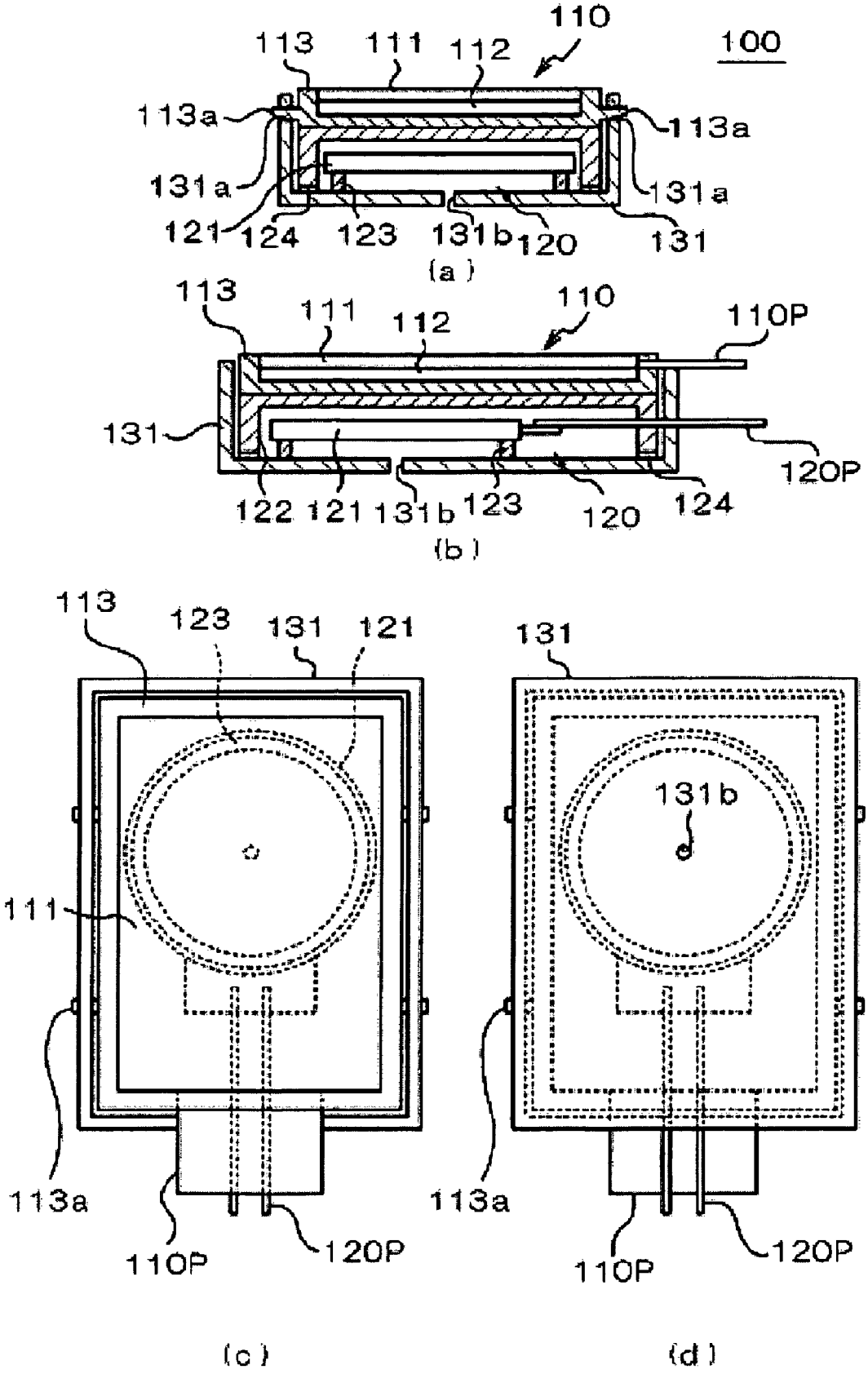
FIGS. 1A and 1B show cross-sectional views of a first embodiment.
FIG. 1C shows a plan view of the first embodiment and FIG. 1D shows a bottom view of the first embodiment.
Figure 4:
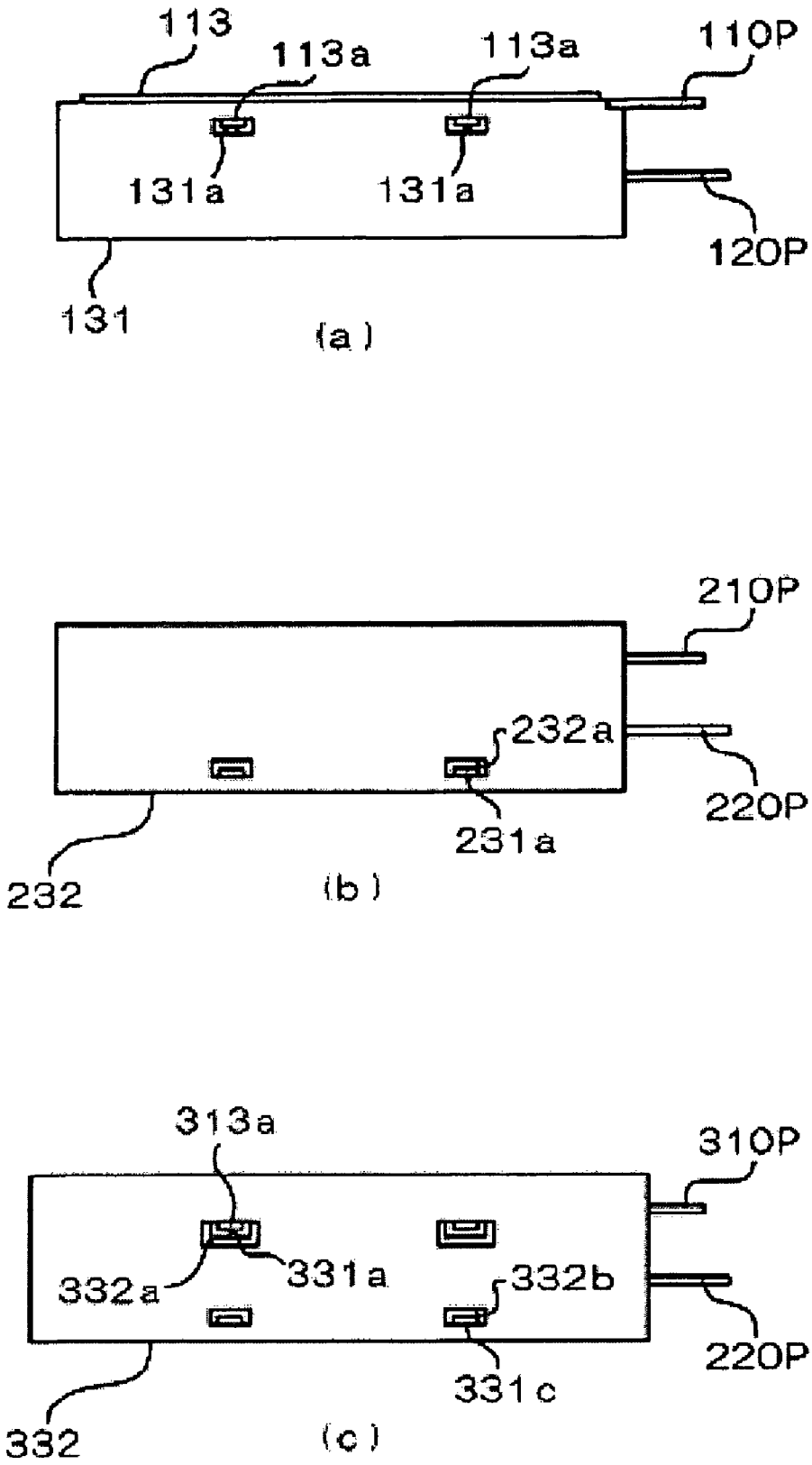
FIG. 4A shows a side view of the first embodiment.
FIG. 4B shows a side view of the second embodiment.
FIG. 4C shows side view of the third embodiment.

FIG. 1A shows a cross-sectional view showing a cross section taken along one direction (direction of the shorter side); FIG. 1B shows a cross-sectional view showing a cross section taken along the other direction (direction of the longer side); FIG. 1C shows a plan view; and FIG. 1D shows a bottom view of the electro-optical device with a sound generating body 100 according to the present invention. FIG. 4A is a side view of the electro-optical device with a sound generating body 100. The electro-optical device with a sound generating body 100 includes a display unit 110 provided with an electro-optical panel 111 and a sound generating unit 120 provided with a sound generating body 121.

The electro-optical panel 111 may be formed of various electro-optical devices such as a liquid crystal display panel, an organic electroluminescence panel, a plasma display panel, or a field emission panel. However, in this specification, it is basically assumed to be a liquid crystal display panel for description. The display unit 110 includes a back light 112 that illuminates the electro-optical panel 111 from backside disposed therein. The electro-optical panel 111 and the back light 112 are held and fixed by a panel holding frame 113 (first frame). When a self-emitting panel other than the liquid crystal display panel is used as the electro-optical panel 111, the backlight is not necessary.

Figure 12:
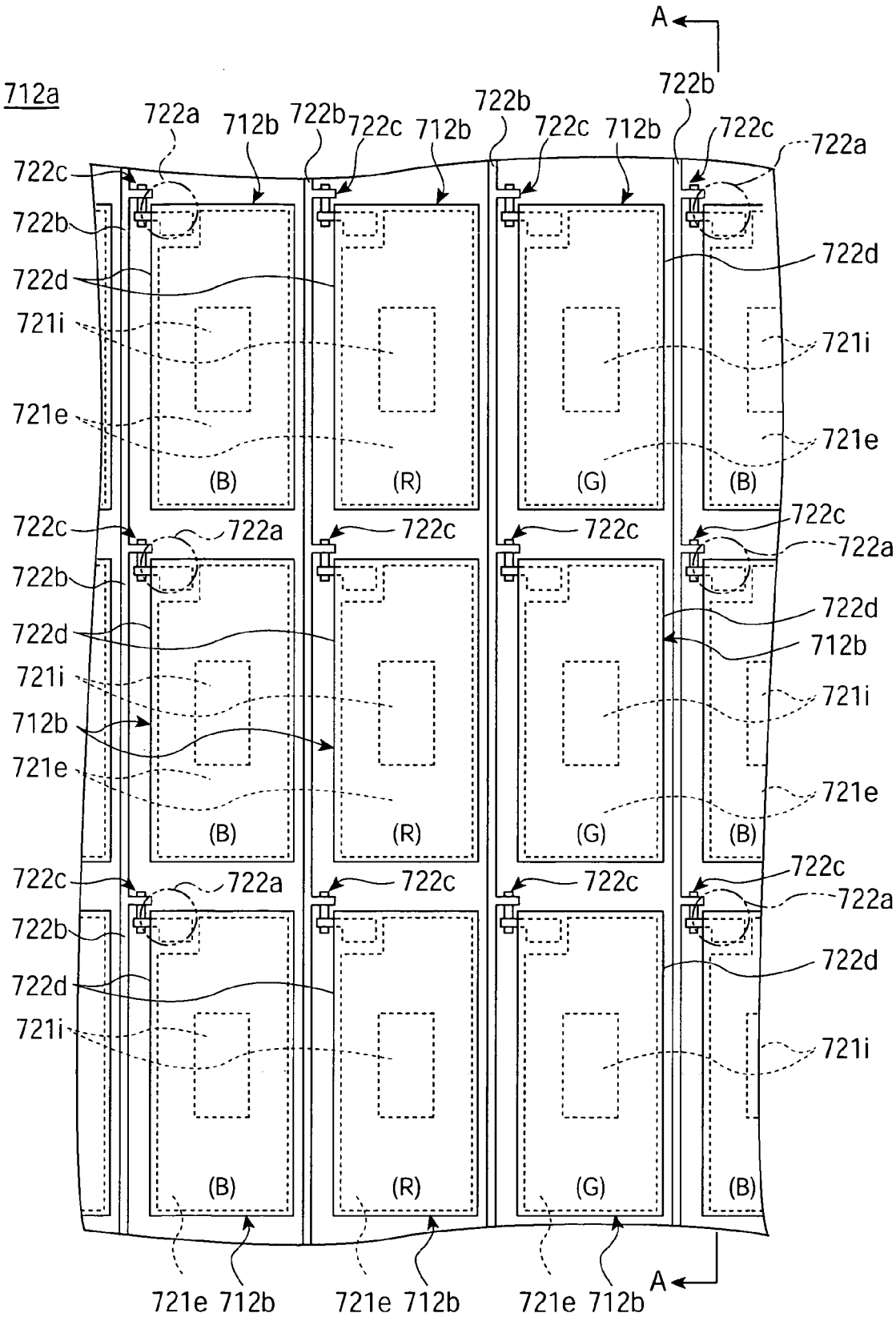
FIG. 12 is a schematic block diagram of an electro-optical panel 111.
Figure 13:
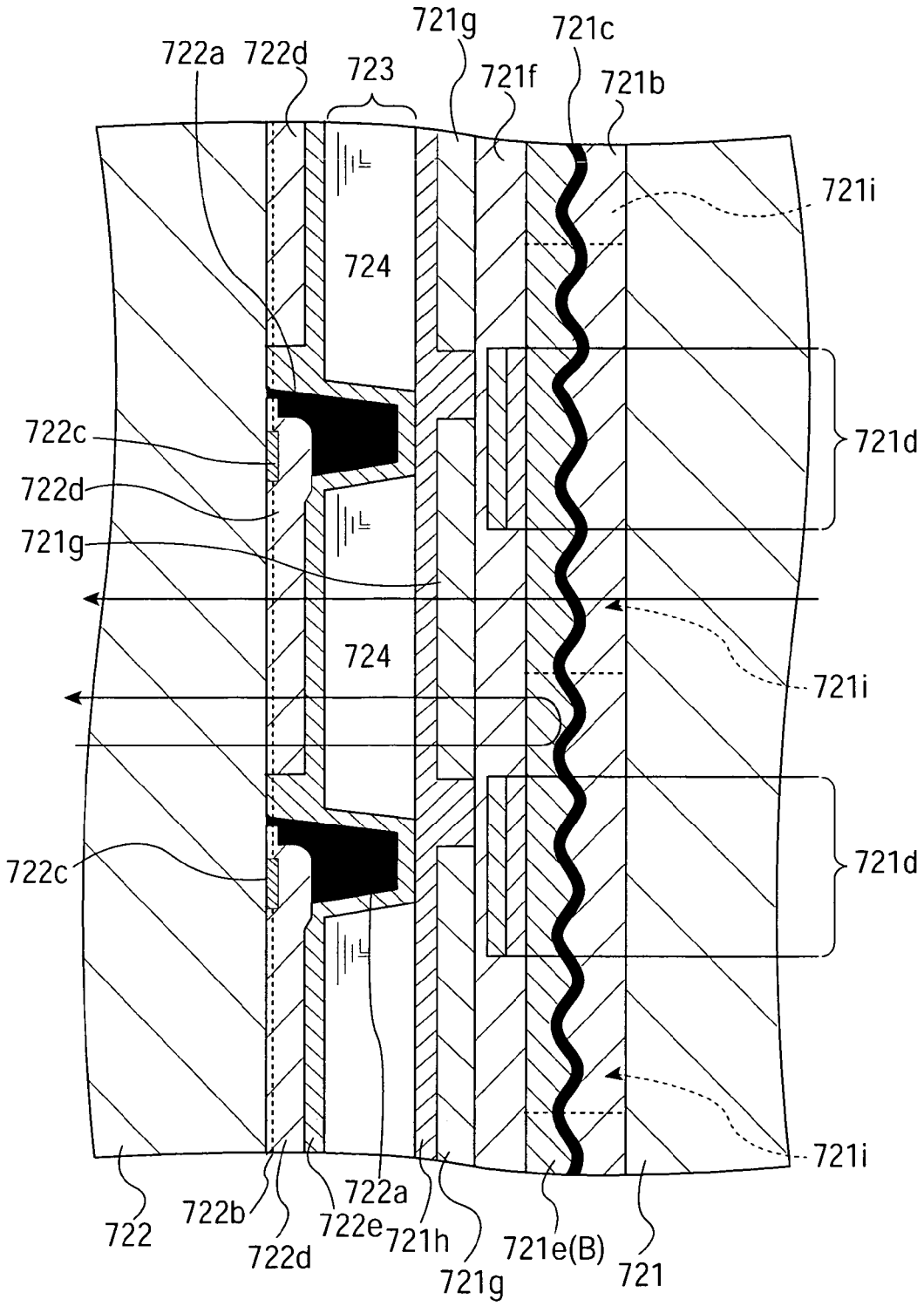
FIG. 13 is a cross-sectional view taken along the line A-A in FIG. 12.

FIG. 12 is a drawing showing an example of the structure of the electro-optical panel 111, and FIG. 13 is a cross-sectional drawing taken along the line A-A in FIG. 12. Here, for example, a case in which a transflective liquid crystal display unit is used as the electro-optical panel 111 will be described. As shown in FIG. 12, a liquid crystal display device is provided with an image display unit 712*a* including a plurality of display dots 712*b* so as to be viewable from the surface (upper side in FIG. 12). The liquid crystal display device includes an opposing pair of substrates, that is, a color filter substrate (CF substrate) 721 and an element substrate 722, an annular seal provided therebetween, and liquid crystal to be encapsulated within the annular seal. Formed between the CF substrate 721 and the element substrate 722 is a gap, that is a cell gap 723, formed by spacers 722*a*, as shown in FIG. 13, and liquid crystal is encapsulated within the cell gap 723 to form a liquid crystal layer 724. The CF substrate 721 is formed of translucent glass or translucent synthetic resin, a scattering layer 721*b* is formed on the surface on the side of the liquid crystal, and a reflective layer 721*c* is formed on the scattering layer 721*b*. The scattering layer 721*b* is formed of translucent synthetic resin or the like, and the surface on the side of the liquid crystal is formed with projections and depressions at random. The reflective layer 721*c* is formed with projections and depressions as in the case of the scattering layer 721*b* at random, so that a light beam coming into the reflective layer 721*c* reflects as scattering beams. The reflective layer 721*c* is formed with an opening 721*i* at a predetermined position.

Light-shielding layers 721*d* are formed on the reflective layer 721*c*, and, as shown in FIG. 12, a plurality of colored layers 721*e* are formed two-dimensionally between the light-shielding layers 721*d*. The light-shielding layers 721*d* are formed in a lattice-like shape so as to surround the colored layers 721*e*, although it is not shown in the drawing. In the cross-sectional structure (cross-section taken along the line A-A) shown in FIG. 13, only the colored layer 721*e* of B (blue), which is one of three primary colors of additive color mixture, is shown as the colored layer 721*e*. However, actually, the colored layers 721*e* of other colors, R (red) and G (green), are provided at the planer position different from the colored layer 721*e*(B), as shown in FIG. 12. Although the plurality of colored layers 721*e* of R, G, and B are arranged in stripe alignment in FIG. 12, it is not limited thereto, and delta alignment or mosaic alignment may also be applicable. Although the light-shielding layers 721*d* are formed by laminating the plurality of colored layers 721*e* of R, G, and B, it is not limited thereto, and, for example, it may be formed by patterning Cr in lattice-like pattern by a method using a suitable patterning method, such as photolithography processing.

An overcoat layer 721*f* is formed on the light-shielding layers 721*d* and the colored layers 721*e*, band-shaped transparent electrodes 721*g* are formed on the overcoat layer 721*f*, and an orientation film 721*h* is formed thereon. The overcoat layer 721*f* is formed of translucent synthetic resin or the like, that protects the light-shielding layers 721*d* and the colored layers 721*e* formed under the overcoat layer 721*f*. The single band-shaped transparent electrode 721*g* extends in the direction perpendicular to the plane of paper in FIG. 13, and the light-shielding layers 721*d* are disposed between the adjacent transparent electrodes 721*g*. An orientation process, such as rubbing process is conducted on the orientation film 721*h*, so that the orientation of the liquid crystal molecular in the vicinity of the orientation film 721*h* of the liquid crystal layer 724 is determined. A deflecting plate is attached to the surface of the CF substrate 721 on the side opposite from the liquid crystal.

The element substrate 722 opposing to the CF substrate 721 is formed of translucent glass or translucent synthetic resin, and as shown in FIG. 13, spacers 722*a*, a linear line wiring 722*b*, a plurality of elements 722*c*, and a plurality of transparent electrodes 722*d* are formed on the surface of the side of the liquid crystal. The spacers 722*a* are formed of photosensitive synthetic resin material, and as shown in FIG. 12, cover the elements 722*c* on the sides of the liquid crystal, and are formed so as to overlap the end portions of the transparent electrodes 722*d*. Over these elements (722*a*-722*d*) there is formed an orientation film 722*e*. Orientation process, for example, rubbing processing is conducted on the orientation film 722*e*, so that the orientation of the liquid crystal molecules in the vicinity of the orientation film 722*e* of the liquid crystal layer 724 is determined. A deflecting plate is attached to the surface of the element substrate 722 on the opposite side from the liquid crystal. Here, the spacers 722*a* are formed into a column shape by patterning by a method using, for example, photolithography processing, and the distal ends thereof abut against the orientation film 721*h* formed on the CF substrate 721 via the orientation film 722*e*. In other words, the spacers 722*a* are formed so as to project toward the opposed CF substrate 721, and are completely fixed between the CF substrate 721 and the element substrate 722. The shape of the column-shaped spacers 722*a* includes a conical shape with the distal portion removed, a pyramid shape with the distal end removed, and other given shapes. The areas in which the transparent electrodes 721*g* of the CF substrate 721 overlap the transparent electrodes 722*d* of the element substrate 722 correspond to the display dots 712*b* of the image display unit 712*a* described above.

Even when vibrations are transmitted from the sound generating body 121 to the electro-optical panel 111, since the column-shaped spacers 722*a* provided on the element substrate 722 are completely fixed to the element substrate 722, the column-shaped spacers 722*a* do not move on the element substrate 722. Also, since the distal end of the column-shaped spacer 722*a* abuts against the orientation film 721*h* of the CF substrate 721 that opposes the element substrate via an orientation film 722*e*, the positions of the CF substrate 721 and the element substrate 722 do not move from the predetermined positions. Accordingly, abnormal display of the image display unit by generation of sounds at the sound generating body 121 can further be prevented.

Although the spacers 722*a* are provided on the side of the element substrate 722 of the electro-optical panel 111 in the present embodiment, the present invention is not limited thereto, and the spacers may be provided on the side of the CF substrate 721. Although the spacers 722*a* provided on the side of the element substrate 722 are provided so as to cover the elements 722*c*, they may be provided on the element substrate 722 at the positions other than the elements 722*c*. As shown in FIG. 12, although the spacers 722*a* are provided at regular intervals (for example, only at the display dots 712*b* having B (blue) formed on the colored layers 721*e*) in the present embodiment, the present invention is not limited thereto. For example, it is also possible to form spacers 722*a* only on the display dots 712*b* having R (red) or G (green) formed on the colored layers 721*e*, or to form spacers 722*a* on all the display dots 712*b*.

The liquid crystal display device may be by any one of a passive matrix type and an active matrix type, and if it is the active matrix type, any one of thin film diode (TFD) and thin film transistor (TFT) may be employed as a switching element. The mode of orientation of the liquid crystal may be various known modes such as TN type, VAN type, STN type, ferroelectric type, or anti-ferroelectric type.

The sound generating body 121 is configured of piezoelectric speaker. The piezoelectric speaker includes a piezoelectric transducer therein, and is configured to generated sound waves by vibrations of the piezoelectric transducer. The sound generating unit 120 is provide with a sound generating frame (third frame) 122 that secures a storage space of the sound generating body 121, and the sound generating body 121 is disposed within the sound generating frame 122.

In the present embodiment, in order to fix the sound generating unit 120 to the display unit 110, a storage frame (second frame) 131 that is attached from the backside of the display unit 110 is provided. The storage frame 131 stores the sound generating body 121 and is detachably fixed to a panel holding frame 113 of the display unit 110. More specifically, the storage frame 131 is formed with engaging devices (openings) 131*a*, and the storage frame 131 is fixed to the panel holding frame 113 by the engaging devices 131*a* which engages the engaging devices (projections) 113*a* formed on the outer surface of the panel holding frame 113.

The sound generating body 121 is supported by and fixed to the storage frame 131 via a supporting member 123. The supporting member 123 is provided for fixing the sound generating body 121 disposed within the storage frame 131 at a predetermined position while maintaining the vibratable state. Therefore, the supporting member 123 may be anything as long as it can reliably supporting and fixing the sound generating body 121 and, more preferably, it is formed of a shock absorbing member having a flexibility to a certain extent so that it does not disturb vibrations of the sound generating body and it prevents vibrations from transmitting directly to the storage frame 131 itself.

The sound generating frame 122 is supported by and fixed to the storage frame 131 via a shock absorbing member 124. The shock absorbing member 124 is preferably formed of material having flexibility to some extent in order to absorb dimensional tolerance among the panel holding frame 113, the sound generating frame 122, and the storage frame 131.

The sound generating frame 122 is a member that allows the sound generating body 121 to be stored between the panel holding frame 113 and the storage frame 131 and for enabling the same to generate sounds, and, in addition, for securing a space for increasing a sound volume of the sound generating body 121. For example, with the provision of the sound generating frame 122, an air chamber can be fixed to the sound generating body 121 on the opposite side of the sound discharging side. Therefore, as long as the space is secured by the structure of the panel holding frame 113 and the storage frame 131, the sound generating frame 122 is not necessary.

A sound releasing port 131*b* is formed on the bottom surface of the storage frame 131 opposing to the sound generating body 121. In the embodiment, the sound generating body 121 is configured to release sounds from the sound releasing port 131*b*-formed on the backside thereof. At this time, it is preferable to employ a configuration such that a space between the sound generating body 121 and the storage frame 131 which is in communication with the sound releasing port 131*b* is sealed by the supporting member 123 that supports and fixes the sound generating body 121 except for the sound generating port 131*b*. In other words, the supporting member 123 separates the space between the upper surface of the sound generating body 121 and the panel holding frame 113 from the space between the lower surface of the sound generating body 121 and the storage frame 131. Accordingly, the sounds generated by the sound generating body 121 can be radiated efficiently from the sound releasing port 131*b*.

It is also possible to form another sound releasing port on the storage frame 131 or on the panel holding frame 113. In this case, one of the sound releasing ports serves as an air vent that purges air for facilitating vibrations of the sound generating body 121 by moving air. Sounds are also released from this sound releasing ports, but sounds from this port are not used, and sound released from the other sound releasing port are recognized by a user of the electro-optical device with a sound generating body.

It is also preferable that the space located on the opposite side of the sound generating body 121 when viewed from the sound releasing port 131*b* is sealed by the sound generating frame 122 and the storage frame 131 (via the shock absorbing material 124). Accordingly, the space located on the opposite side from the sound releasing port 131*b* when viewed from the sound generating body 121 serves as an air chamber, and can radiate sounds further efficiently from the sound releasing port 131*b*. Although the air chamber is defined by the sound generating frame 122 and the storage frame 131 in an example shown in the drawing, it is also possible to omit the sound generating frame 122 to define the air chamber by the display unit 110 and the storage frame 131.

Although no inclusion exists between the sound generating body 121 and the sound generating frame 122 in the present embodiment, it is also possible to interpose a suitable supporting member therebetween.

A wiring member 110P composed of a flexible wiring board or the like is connected to the display unit 110, and is led to the outside of the panel holding frame 113 and the storage frame 131. A wiring member 120P is connected to the sound generating unit 120, and is led to the outside of the sound generating frame 122 and the storage frame 131.

This embodiment has a structure in which the storage frame 131 that stores the sound generating body 121 is fixed to the display unit 110 from the backside. Accordingly, the sound generating unit 120 including the sound generating body 121 and the display unit 110 can easily be integrated, whereby the electro-optical device 100 with a sound generating body can be formed compactly.

Since the sound generating unit 120 is formed within the storage frame 131, an acoustic environment such as the air chamber can be formed within the storage frame 131. Therefore, it is not necessary any longer to provide an acoustic design the outside the storage frame 131, for example, in the enclosure of the electronic apparatus in which the electro-optical device is installed, and hence stable sound generating property is achieved irrespective of the type of the electronic apparatus to which it is installed.

Also, since the sound generating body 121 is fixed to the storage frame 131 via the supporting member 123, a state which does not affect sound generation of the sound generating body 121 without depending on the structure of the display unit is achieved. Therefore, stable sound generating property is achieved even when the structure of the display unit is modified.

Second Embodiment

Figure 2:
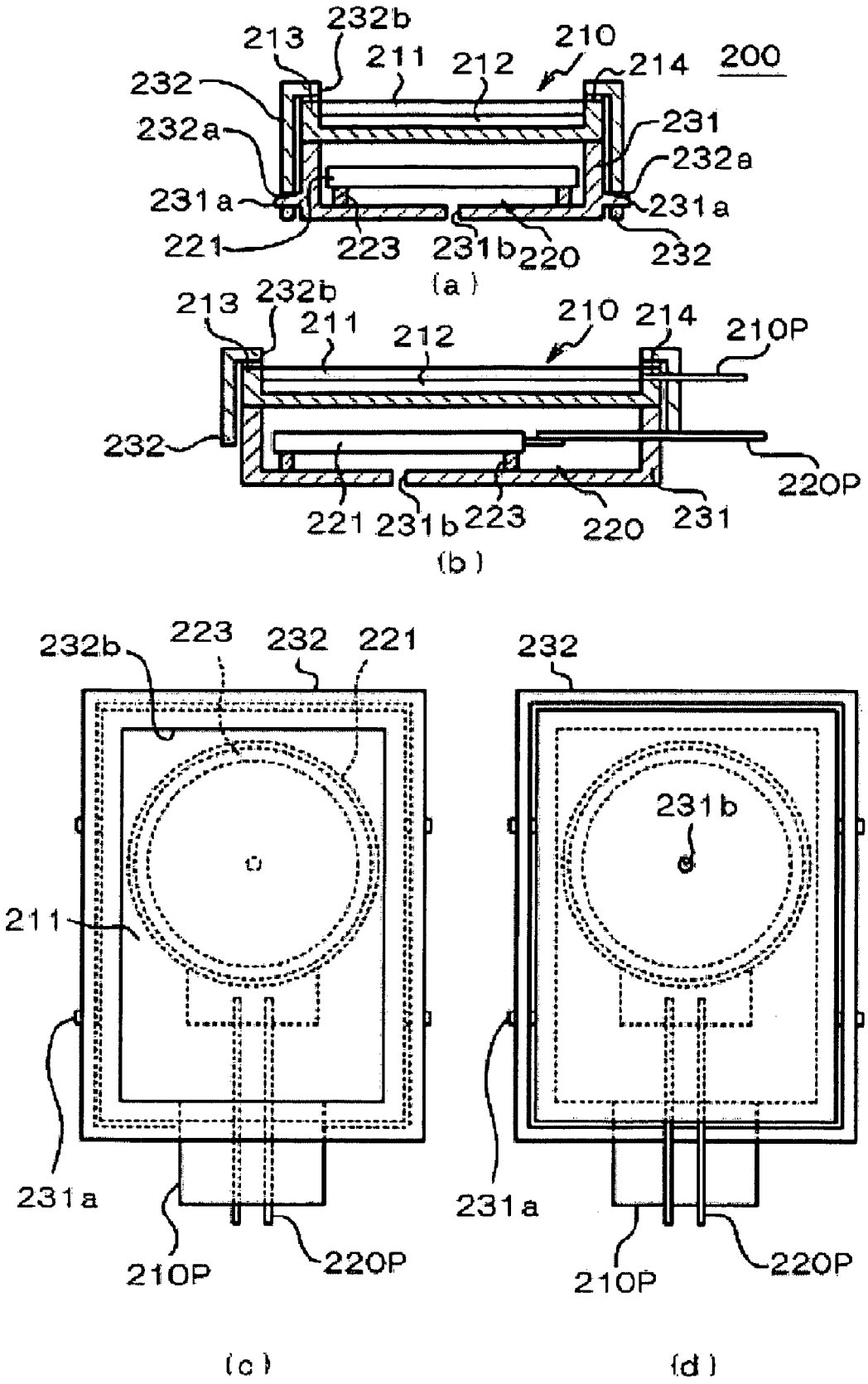
FIGS. 2A and 2B show cross-sectional views of a second embodiment.
FIG. 2C shows a plan view of the second embodiment and FIG. 2D shows a bottom view of the second embodiment.

Referring now to FIGS. 2A to 2D, a second embodiment of the present invention will be described. FIG. 2A shows a cross-sectional view showing a cross section along one direction (direction of the shorter side) of an electro-optical device 200 with a sound generating body of the second embodiment; FIG. 2B shows a cross-sectional view showing a cross section along another direction (direction of the longer side); FIG. 2C shows a plan view; and FIG. 2D shows a bottom view. FIG. 4B is a side view of the electro-optical device 200 with a sound generating body.

The electro-optical device 200 with a sound generating body includes a display unit 210 provided with an electro-optical panel 211, and a sound generating unit 220 provided with a sound generating body 221. Since the electro-optical panel 211, a back light 212, a panel holding frame 213, the sound generating body 221, a supporting member 223, wiring members 210P, and 220P are the same as those in the first embodiment, description about these members will not be made.

In this embodiment, a storage frame (second frame) 231 is arranged directly on the backside of the panel holding frame 213 (third frame), and the sound generating body 221 and the supporting member 223 are supported and fixed within the storage frame 231 as in the first embodiment. The storage frame 231 is formed with a sound releasing port 231*b* as in the first embodiment. The storage frame 231 of this embodiment is different from the first embodiment in that it is not directly fixed to the panel holding frame 213, but is only simply abutted from the backside. The outer surface of the storage frame 231 is formed with an engaging device (projections) 231*a*.

In this embodiment, a fixed frame (first frame or a cover frame) 232 is fixed to the panel holding frame 213 from the front side. The fixed frame 232 abuts against the front surface of the panel holding frame 213 via the shock absorbing member 214 so as to extend toward the backside. The fixed frame 232 is provided with engaging devices (openings) 232*a* that engage the engaging devices 231*a* formed on the outer surface of the storage frame 231. Accordingly, the storage frame 231 is fixed to the display unit 210 from the backside by the fixed frame 232. In other words, the fixed frame 232 presses and holds the panel holding frame 213 and the storage frame 231 in the fore-and-aft direction with respect to each other, and integrates the display unit 210 and the sound generating unit 220. An opening 232*b* which enables the electro-optical panel 211 to be viewed is formed on the front surface of the fixed frame 232.

According to the present embodiment, since the storage frame 231 that stores the sound generating body 221 is disposed on the backside of the display unit, and the storage frame 231 is fixed to the display unit 210 by the fixed frame 232 that is fixed from the front surface of the display unit 210, the display unit 210 and the sound generating unit 220 can be fixed and integrated further firmly. In this embodiment, since it is not necessary to fix the storage frame 231 directly to the panel holding frame 213, the storage frame 231 can be fixed indirectly to the panel holding frame 213 irrespective of the shape or the structure of the panel holding frame 213.

Third Embodiment

Figure 3:
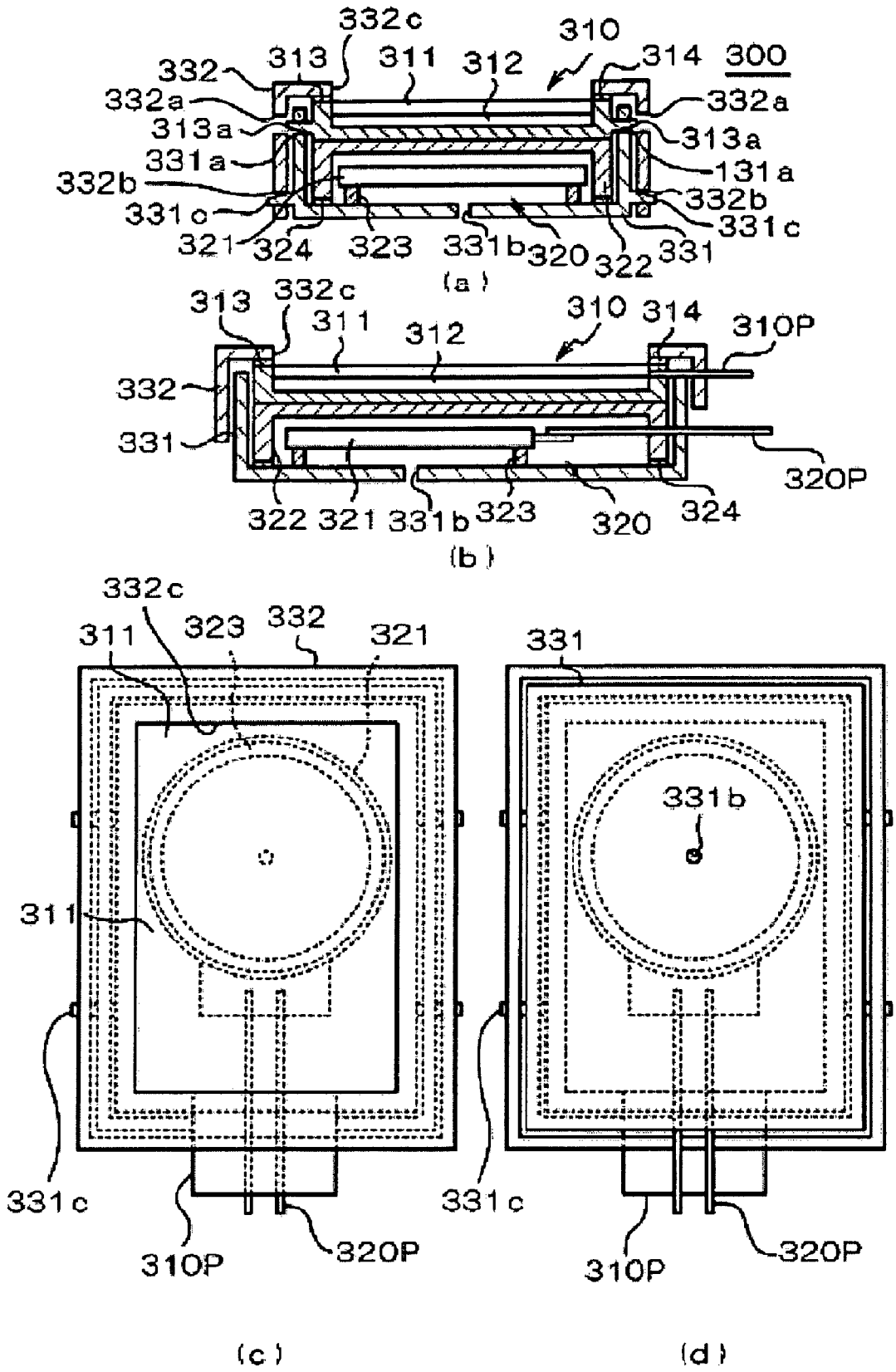
FIGS. 3A and 3B show cross-sectional views of a third embodiment.
FIG. 3C shows a plan view of the third embodiment and FIG. 3D shows a bottom view of the third embodiment.

Referring now to FIGS. 3A to 3D, a third embodiment of the present invention will be described. FIG. 3A shows a cross-sectional view showing a cross section taken along one direction (direction of the shorter side) of an electro-optical device 300 with a sound generating body of the third embodiment; FIG. 3B shows a cross-sectional view showing a cross section taken along another direction (direction of the longer side); FIG. 3C shows a plan view and FIG. 3D shows a bottom view. FIG. 4C is a side view of the electro-optical device 300 with a sound generating body.

In the electro-optical device 300 with a sound generating body according to this embodiment includes a display unit 310 provided with an electro-optical panel 311 and a sound generating unit 320 provided with a sound generating body 321. The electro-optical panel 311, a backlight 312, a panel holding frame 313, the sound generating body 321, a sound generating frame 322, a supporting member 323, a shock absorbing member 324, wiring members 310P, 320P are the same as those in first embodiment, and hence description of these members will not be made.

In this embodiment, in addition to the structure which corresponds to the first embodiment in which the storage frame 331 is fixed to the display unit 310 from the backside and the storage frame 331 is formed with a sound releasing port 331*b*, a fixed frame (first frame or a cover frame) 332 as the one stated in the second embodiment is attached. In other words, the fixed frame 332 is to be fixed to the display unit 310 from the front side as in the case of the second embodiment, and is abutted against the front surface of the panel holding frame (third frame) 313 via the shock absorbing member 314. Engaging devices (projections) 331*c* are formed on the outer surface of the storage frame (second frame) 331, and these engaging devices 331*c* engage engaging devices (openings) 332*b* provided on the fixed frame 332. The fixed frame 332 is formed with openings 332*a* at the positions corresponding to the engaging devices 313*a* so as to prevent contact with the engaging devices 313*a* of the panel holding frame 313. The fixed frame 332 is also formed with an opening 332*c* that enables the electro-optical panel 331 to be viewed from the front as in the second embodiment.

In this embodiment, in addition to the effects in the first embodiment, the fixed frame 332 fixes the display unit 310 and the storage frame 331 in a clamped manner. Therefore, it has such effects that the rigidity of the device can be increased, and vibrations generated at the sound generating unit 320 can hardly be transmitted to the display unit 310.

Fourth Embodiment

Figure 5:
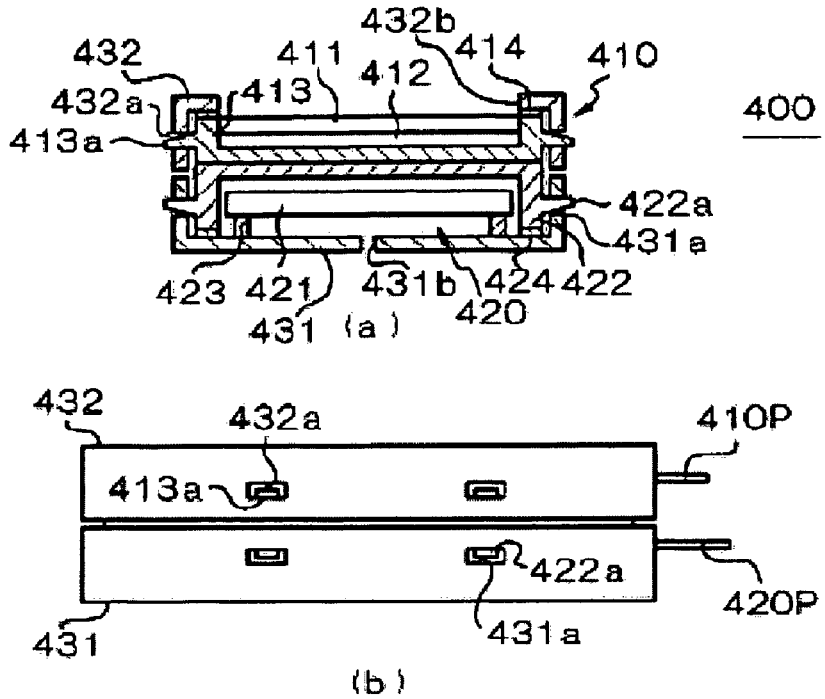
FIG. 5A shows a cross-sectional view of a fourth embodiment and FIG. 5B shows a side view of the fourth embodiment.

Referring now to FIGS. 5A and 5B, an electro-optical device 400 with a sound generating body according to a fourth embodiment will be described. FIG. 5A is a cross-sectional view showing a cross-section taken along one direction (direction of the shorter side) of the electro-optical device 400 with a sound generating member, and FIG. 5B is a side view.

In this embodiment, a display unit 410, an electro-optical panel 411, a back light 412, a panel holding frame 413, a sound generating unit 420, a sound generating body 421, a sound generating frame 422, a supporting member 423, a shock absorbing member 424, a storage frame 431 provided with a sound releasing port 431*b*, and wiring members 410P, 420P are almost the same as those in the first embodiment, and descriptions about these members will not be made.

However, engaging devices (openings) 431*a* formed on the storage frame 431 (second fame) engage engaging devices (projections) 422*a* provided on the sound generating frame 422. The panel holding frame 413 is also formed with engaging devices (projections) 413*a*.

A fixed frame (first frame or cover frame) 432 to be fixed to the display unit 410 from the front side is provided, and the fixed frame 432 abuts against the front surface of the panel holding frame 413 via the shock absorbing member 414. The fixed frame 432 is provided with engaging devices (openings) 432*a* and the engaging devices 432*a* engage the engaging devices 413*a* of the panel holding frame 413. The fixed frame 432 is also provided with openings 432*b*, which enables the electro-optical panel 411 to be viewed from the front in the same manner as described above.

This embodiment is based on an assumption that the panel holding frame 413 and the sound generating frame 422 disposed on the backside are fixed (secured) to each other, or formed integrally with each other (that is, formed into an unitized third frame). Accordingly, the sound generating unit 420 and the display unit 410 can be formed integrally by fixing the storage frame 431 from the backside. Also, the fixed frame 432 can be fixed to the panel holding frame 413 from the front side irrespective of the sound generating unit 420.

Fifth Embodiment

Figure 6:
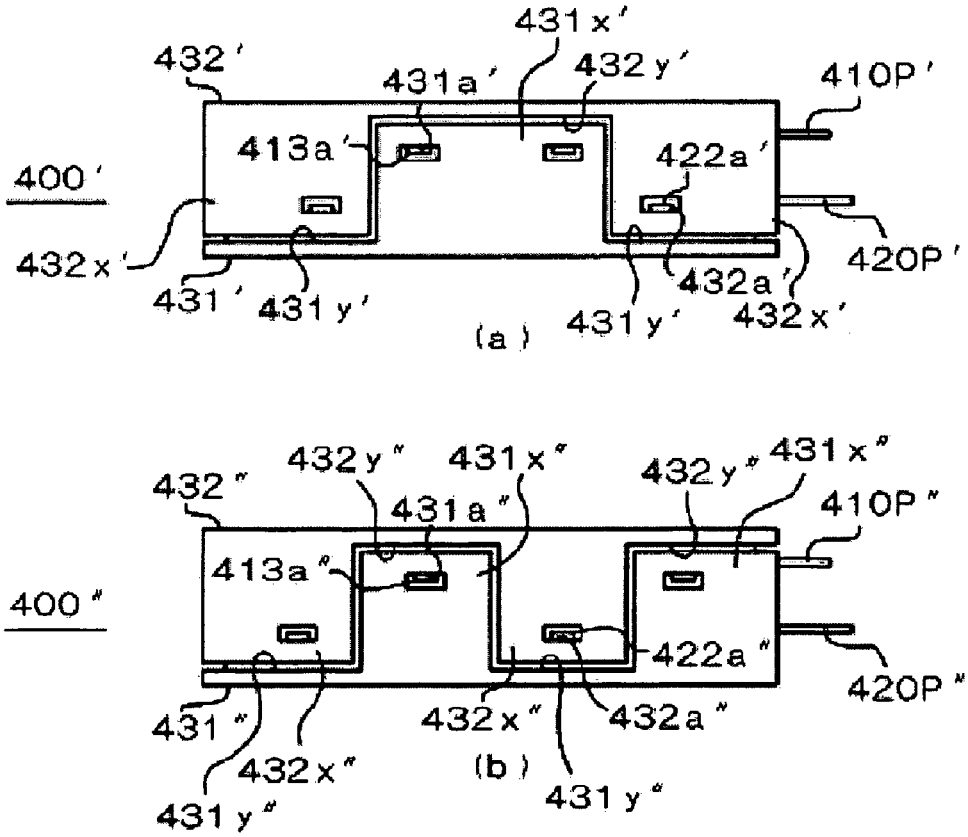
FIGS. 6A and 6B shows side views of a fifth embodiment.

Referring now to FIGS. 6A and 6B, a modification of the electro-optical device 400 of the fourth embodiment of the present invention will be described as a fifth embodiment. FIG. 6A is a side view of an electro-optical device 400' with a sound generating body; and FIG. 6B is a side view of an electro-optical device 400" with a sound generating body.

In the electro-optical device 400' with a sound generating body according to the modification shown in FIG. 6A, a display unit 410', an electro-optical panel 411', a back light 412', a sound generating unit 420', a sound generating body 421', a supporting member 423', a shock absorbing member 424', wiring members 410P', 420P' are almost the same as those in the fourth embodiment, and hence description of the same parts will not be made.

The panel supporting frame 413 and the sound generating frame 422 (third frame) are different from the fourth embodiment in position and number of engaging devices 413*a*', 422*a*', and are also different from the fourth embodiment in that the panel holding frame 413 and the sound generating frame 422 may be or may not be fixed to each other. Other forms or structures are the same.

In this embodiment, a storage frame (second frame) 431' and a fixed frame (first frame) 432' are different from the fourth embodiment in shape, as shown in the drawing. The storage frame 431' and the fixed frame 432' have a form of being fitted to each other in the direction of the thickness at the side surfaces thereof. In other words, at the center of the side surfaces described above, projections 431*x*' of the storage frames 431' project in the direction of the thickness, and are positioned inside recesses 432*y*' of the fixed frame 432'. At both ends of the side surfaces described above, pairs of projections 432*x*' provided on the fixed frame 432' project respectively in the direction of the thickness and are disposed inside recesses 431*y*' of the storage frame 431', respectively.

Then, the projections 431*x*' of the storage frame 431' are formed with engaging devices (openings) 431*a*', and the engaging devices 431*a*' engage the engaging devices (projections) 413*a*' of a panel fixed frame 413' (not shown). The projections 432*x*' of the fixed frame 432' are formed with engaging devices (openings) 432*a*', and the engaging devices 432*a*' engage the engaging devices (projections) 422*a*' of the sound generating frame 422' (not shown).

In this arrangement, the panel fixed frame 413' (not shown) and the sound generating frame 422' (not shown) can be fixed to each other by the storage frame 431' and the fixed frame 432', so that the display unit and the sound generating unit can be integrated. Also, since the storage frame 431' and the fixed frame 432' are fitted in the direction of thickness alternately at the side surfaces, the rigidity of the entire device can be increased.

FIG. 6B shows another example, which is basically the same as the modification described above, but is different in fitting mode between a storage frame 431" and a fixed frame 432" at the side surfaces. In this example, the side surfaces are configured in such a manner that the storage frame 431" is formed with projections 431*x*" and recesses 431*y*" at two positions each, and the fixed frame 432" is also formed with projections 432*x*" and recesses 432*y*" at two positions each. Then, these projections and recesses of two sets each are adapted to be alternately fitted in sequence along the extensions of the side surfaces. The projections 431*x*" are formed with engaging devices (openings) 431*a*", and the engaging devices 431*a*" engage engaging devices (projections) 413*a*". Also, the projections 432*x*" are formed with engaging devices (openings) 432*a*", and the engaging devices 432*x*" engage engaging devices (projections) 422*a*" of the sound generating frame. In this manner, since it is configured that the plurality of projections and recesses are fitted to each other, the rigidity of the entire device can further be increased, and deformation that may be generated by engagement and fixation between the frames may be reduced.

Sixth Embodiment

Figure 7:
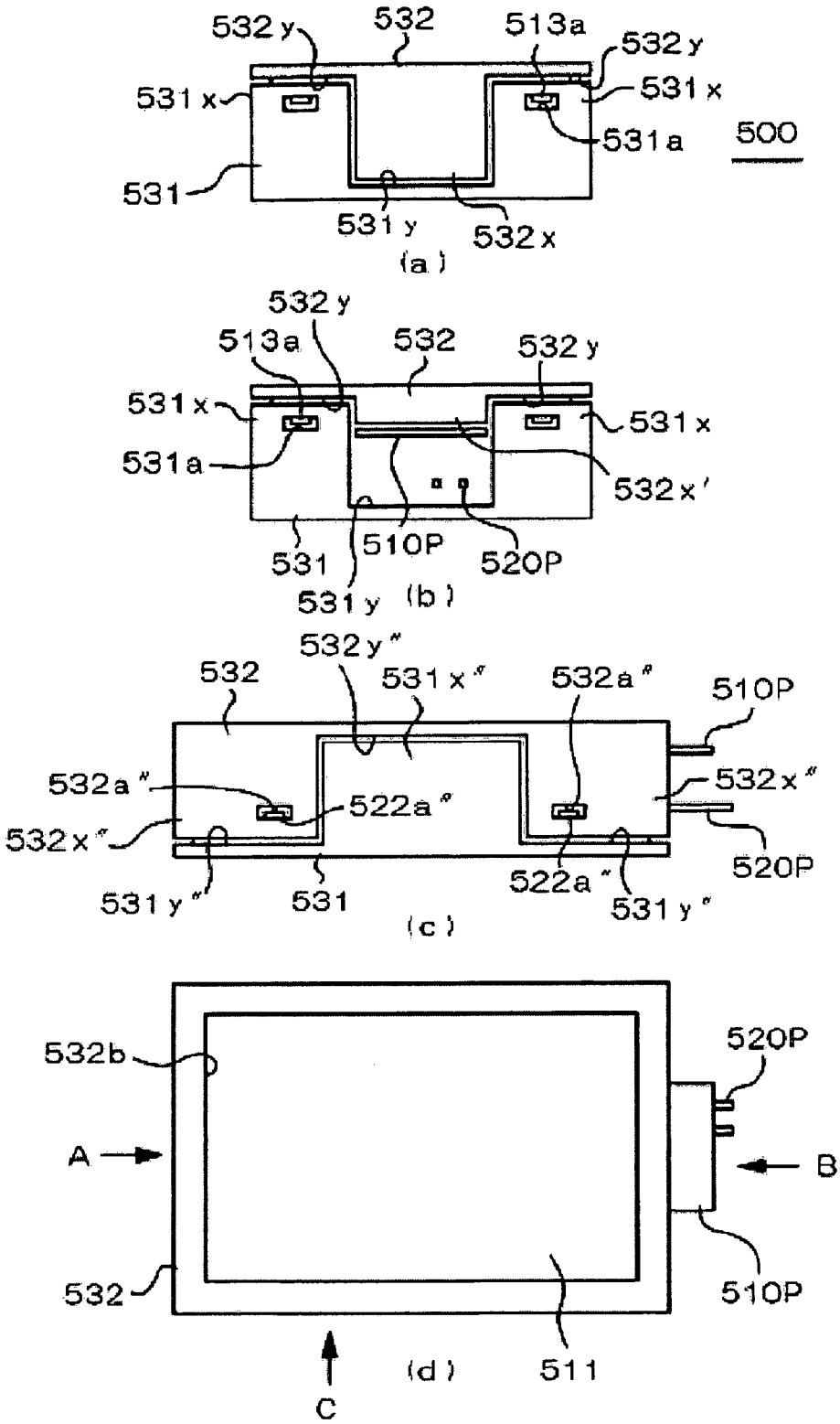
FIG. 7A shows a front view of a sixth embodiment.
FIG. 7B shows a back view of the sixth embodiment.
FIG. 7C shows a right side view of the sixth embodiment and FIG. 7D shows a plan view of the sixth embodiment.

Referring now to FIGS. 7A to 7D, an electro-optical device 500 with a sound generating body in a sixth embodiment of the present invention will be described. FIG. 7A is a front view of the electro-optical device 500 with a sound generating body; FIG. 7B is a back view, FIG. 7C is a right side view; FIG. 7D is a plan view. The left side view is symmetry of the right side view shown in FIG. 7C.

In this embodiment, as in the fifth embodiment described above, a display unit having a panel holding frame (third frame) that stores the electro-optical panel, and a sound generating unit including a sound generating body and a supporting member are provided, and the sound generating unit is fixed to the display unit by a storage frame (second frame) 531 from the backside. A fixed frame (first frame) 532 is fixed to the display unit from the front side. The fixed frame 532 is also provided with an opening 532*b* that enables the electro-optical panel to be viewed from the front in the same manner as described above, as shown in FIG. 7D.

The front portion A (see FIG. 7D) of this embodiment is configured in such a manner that projections 531*x* of the storage frame 531 and recesses 532*y* of the fixed frame 532 formed at both ends are fitted to each other, and a projection 532*x* of the fixed frame 532 and a recess 531*y* of the storage frame. 531 formed at the centers thereof are fitted to each other, as shown in FIG. 7A. The pair of projections 531*x* of the storage frame are formed with engaging devices (openings) 531*a*, and the engaging devices 531*a* engage engaging devices (projections) 513*a* of the panel holding frame.

Although the backside portion B (See FIG. 7D) of the embodiment is the same as the front portion A in that the projections 531*x* of the storage frame 531 and the recesses 532*y* of the fixed frame 532 formed at both ends are fitted to each other, as shown in FIG. 7B, a projection 532*x*' of the fixed frame 532 which is to be fitted to the recess 531*y* of the storage frame 531 formed at the centers thereof is projecting in the direction of the thickness only to a small extent, so that an opening is defined between the projection 532*x*' and the recess 531*y*, through which wiring members 510P and 520P are led to the outside.

Furthermore, the side portion C (See FIG. 7D) of the embodiment is configured in such a manner that a projection 531*x*" of the storage frame 531 and a recess 532*y*" of the fixed frame 532 formed at the centers thereof are fitted to each other, and projections 532*x*" of the fixed frame 532 and recesses 531*y*" of the storage frame 531 formed at both ends are fitted to each other, as shown in FIG. 7C. The pair of projections 532*x*" of the fixed frame 532 are formed with engaging devices (openings) 532*a*" respectively, and engaging devices (projections) 522*a*" of the sound generating frame engage the engaging devices 532*a*".

Since the left and right side portions C of the present embodiment are symmetry, the description given above are completely the same for the left side portion and the right side portion.

In this embodiment, since the frame rigidity of the storage frame 531 and the fixed frame 532 can be secured, a countervailing power against deformation of the entire device can be increased correspondingly, and actually, the amount of deformation can be reduced. Also, since the number of positions of engagement and fixation on the respective frames can be reduced while realizing securement of rigidity and reduction of deformation, the manufacturing cost can be reduced, and assembly process can be facilitated.

Seventh Embodiment

Referring now to FIGS. 10A to 10D, an electro-optical device 600 according to a seventh embodiment of the present invention will be described. FIG. 10A is a front view of the electro-optical device 600; FIG. 10B is a back view; FIG. 10C is a right side view; and FIG. 10D is a plan view. The left side view is symmetry of the right side view shown in FIG. 10*c*.

In this embodiment, as in the case of the sixth embodiment, a display unit having a panel holding frame 613 (third frame) that stores the electro-optical panel and a sound generating unit including a sound generating body and a supporting member are provided. The sound generating unit is fixed to the display unit by a storage frame (second frame) 631 from the backside. A fixed frame (first frame) 632 that serves as a cover frame of the electro-optical panel and the panel holding frame is fixed to the display unit from the front side. As shown in FIG. 10D, the fixed frame 632 is provided with an opening 632*b* that enables the electro-optical panel to be viewed.

The front portion A (See FIG. 10D) of this embodiment is configured in such a manner projections 631*x* of the storage frame 631 and recesses 632*y* of the fixed frame 632 formed at both ends are fitted to each other and a projection 632*x* of the fixed frame 632 and a recess 631*y* of the storage frame 631 formed at the centers thereof are fitted to each other, as shown in FIG. 10A. Then, a pair of projections 631*x* of the storing frame are formed with engaging devices (openings) 613*a*, and the engaging devices 631*a* engage engaging devices (projections) 613*a* of the panel holding frame. When the plurality of engaging devices 631*a* are provided, the recesses 631*y* are formed so as not to exceed an imaginary line X-X' connecting the sides of the engaging devices 631*a* on the side of the fixed frame 632. Accordingly, a sufficient height of the storage frame 631 can be secured at the positions of the storage frame 631 where recesses are provided, whereby the frame rigidity can be secured.

Although the back portion B (See FIG. 10D) of the embodiment is the same as the front portion A in that the projections 631*x* of the storage frame 631 and the recesses 632*y* of the fixed frame 632 formed at both ends are fitted to each other, as shown in FIG. 10B, the projection of the fixed frame 632 to be fitted to the recess 631*y* of the storage frame 631 formed at the centers thereof are not formed, and instead, a recess 632*x*' is formed. Accordingly, an opening is defined between the recess 632*x*' and the recess 631*y*, through which wiring members 610P and 620P are led to the outside.

Furthermore, the side portion C (See FIG. 10D) of the embodiment, a projection 631*x*" of the storage frame 631 and a recess 632*y*" of the fixed frame 632 formed at the centers thereof are fitted to each other, and projections 632*x*" of the fixed frame 632 and recesses 631*y*" of the storage frame 631 formed at both ends are fitted to each other, as shown in FIG. 10C. Then, the pair of projections 632*x*" of the fixed frame 632 are formed with engaging devices (openings) 632*a*" respectively, and engaging devices (projections) 622*a*" of the sound generating frame engage the engaging devices 632*a*". When the plurality of engaging devices 632*a*" are provided, the recesses 632*y*" are formed so as not to exceed an imaginary line Y-Y' connecting the sides of the engaging devices 632*a*" on the side of the storage frame 631. Accordingly, a sufficient height of the fixed frame 632 can be secured at the positions of the fixed frame 632 where the recesses are formed, whereby the frame rigidity can be secured.

Since the left and right side portions C of the present embodiment are symmetry, the description given above are completely the same for the left side portion and the right side portion.

Figure 10:
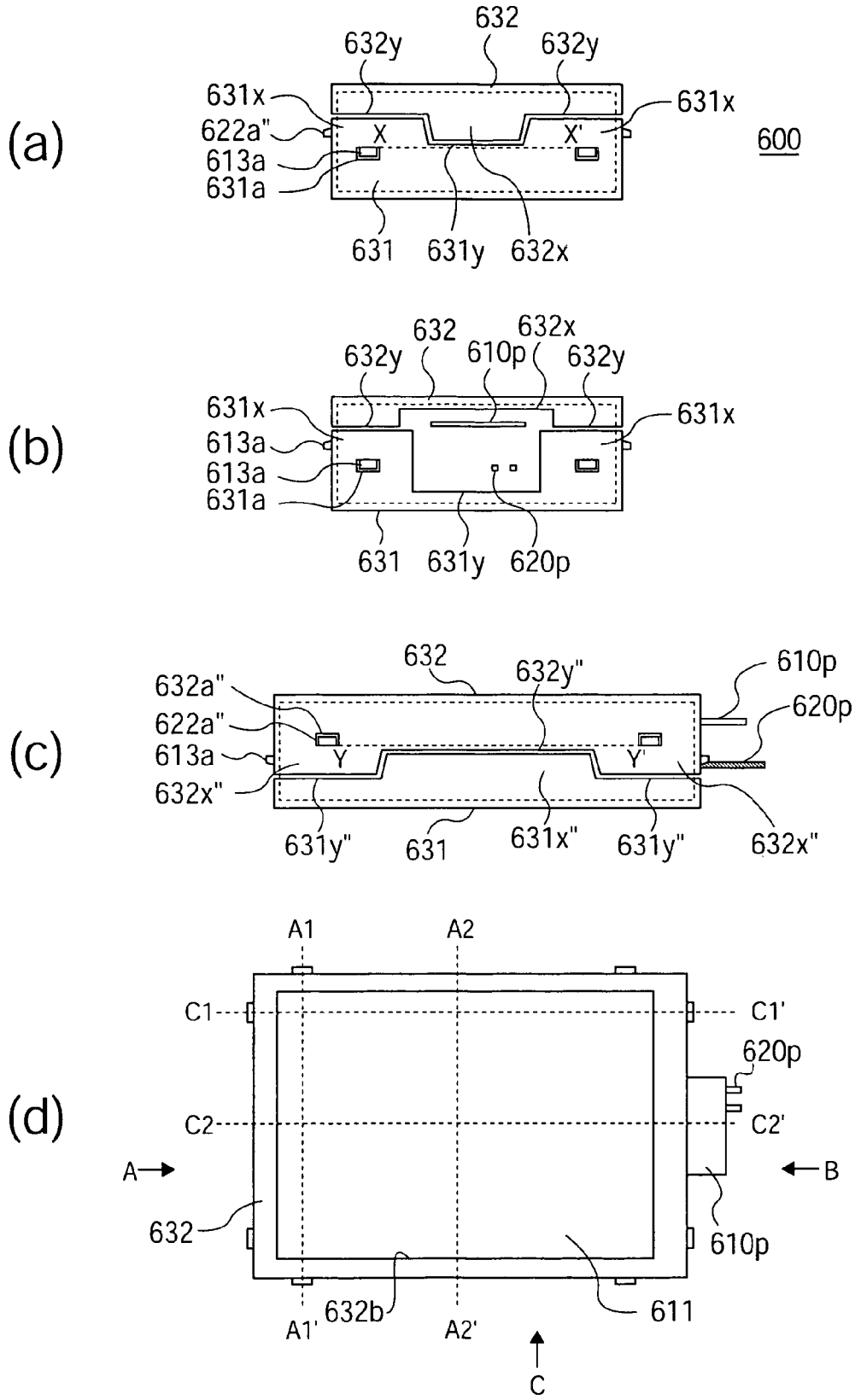
FIG. 10A shows a cross-sectional view of a seventh embodiment.
FIG. 10B shows a back view of the seventh embodiment.
FIG. 10C shows a right side view of the seventh embodiment.
FIG. 10D shows a plan view of the seventh embodiment.

In FIG. 10, 613*a* and 622*a*" are provided so as to project from the storage frame and the fixed frame, it is also possible to provide so as not to project therefrom.

In this embodiment, since the frame rigidity of the storage frame 631 and the fixed frame 632 can be secured, a countervailing power against deformation of the entire device can be increased correspondingly, and actually, the amount of deformation can be reduced. Also, since the number of positions of engagement and fixation on the respective frames can be reduced while realizing securement of rigidity and reduction of deformation, the manufacturing cost can be reduced, and assembly process can be facilitated.

Modification

In the first embodiment to the seventh embodiment, the sound generating frame is provided for enabling the sound generating body to be stored between the panel holding frame and the storage frame and for enabling the same to generate sounds, and, in addition, for securing a space for increasing sound volume of the sound generating body. With the provision of this sound generating frame, the air chamber can be secured on the opposite side of the direction of release of the sound from the sound generating body. However, if the space can be secured by the structure of the panel holding frame or of the storage frame, the sound generating frame is not necessary. A structure in which the sound generating frame is not provided will be described based on the seventh embodiment.

Figure 11:
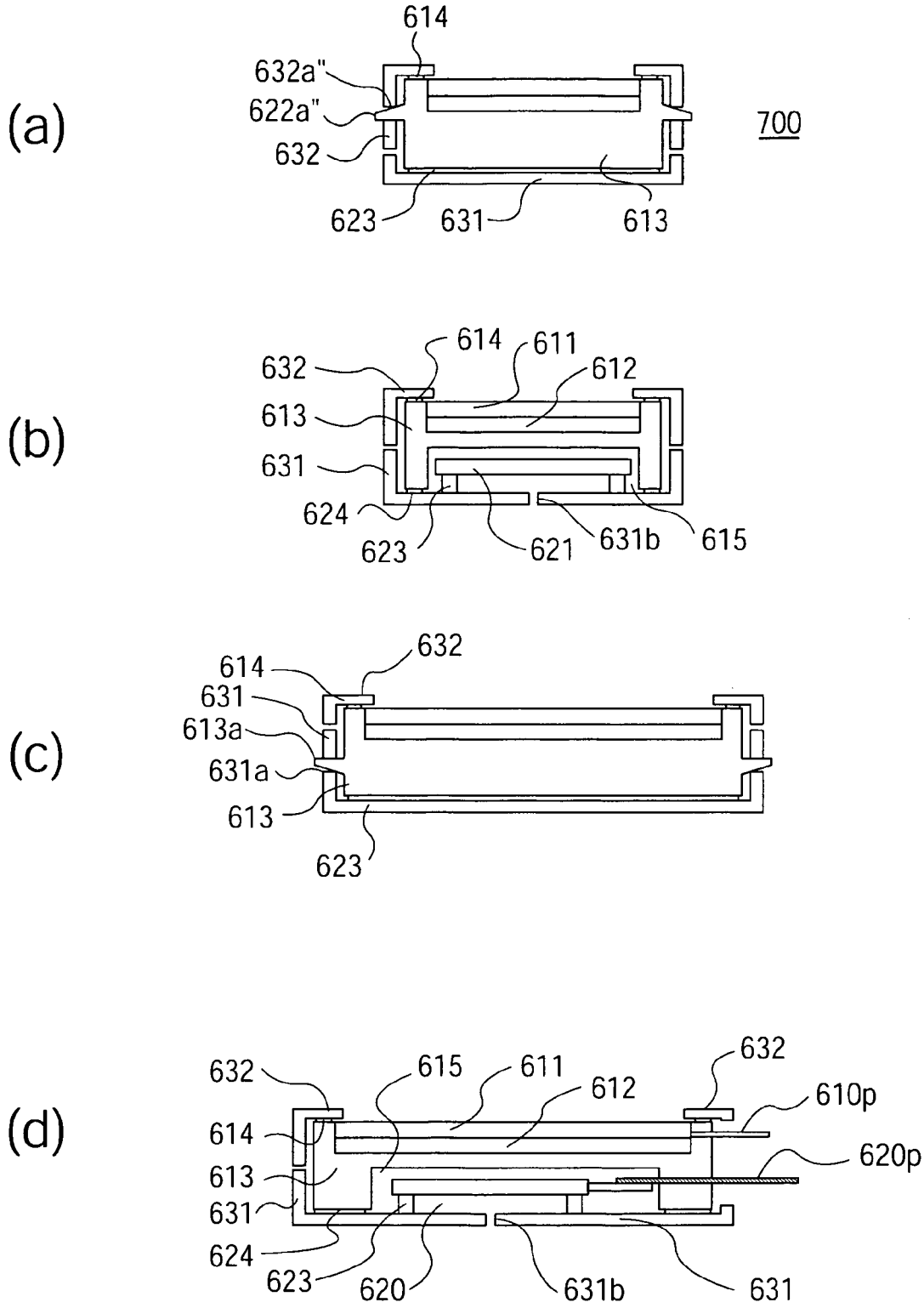
FIG. 11A shows a cross-cross sectional view of a modification.
FIG. 11B shows a cross-sectional view of the modification.
FIG. 11C shows a cross-sectional view of the modification.
FIG. 11D shows a cross-sectional view of the modification.

FIG. 11A shows a cross-cross sectional view showing a cross section taken along the line A1-A1' along one direction (direction of the shorter side) of the electro-optical device 600 with a sound generating body; FIG. 11B shows a cross-sectional view showing a cross section taken along the line A2-A2'; FIG. 11C shows a cross-sectional view showing a cross section taken along the line C1-C1' along another direction (direction of the longer side); and FIG. 11D show a cross-sectional view showing a cross section taken along the line C2-C2'.

The electro-optical device 600 according to the present embodiment includes an electro-optical panel 611 and a sound generating body 621. Since the electro-optical panel 611, a backlight 612, a sound generating body 621, a supporting member 623, and the wiring members 610P, 620P are the same as the first embodiment, description of these members will not be made.

In this embodiment, the storage frame 631 is disposed directly behind the panel holding frame 613, and the sound generating body 621 and the supporting member 623 are supported and secured within the storage frame 631 in the same manner as the first embodiment. A sound releasing port 631*b* is provided on the storage frame 631 as in the case of the first embodiment.

It is also possible to form another sound releasing port on the storage frame 631 or on the panel holding frame 613. In this case, one of the sound generating holes serves as an air vent that purges air for facilitating vibrations of the sound generating body 621 by moving air. Sounds are also released from this sound releasing port, but sounds from this port are not used, and sound released from the other sound releasing port are recognized by a user of the electro-optical device with a sound generating body.

The panel holding frame 613 also serves as the sound generating frame 122 in the first embodiment. In other words, the panel holding frame 613 is provided with a sound generating body storage 615, and is capable of storing the sound generating body 621 at a space formed with the storage frame 631 so as to be capable of generating sounds, and, in addition, secures an air chamber that increases sound volume of the sound generating body 621. For example, with the provision of the panel holding frame 613, an air chamber can be secured on the sound releasing direction of the sound generating body 621.

In the present embodiment, the fixed frame 632 is fixed to the panel holding frame 613 from the front side. The fixed frame 632 abuts against the front portion of the panel holding frame 613 via a shock absorbing member 614 and extends toward the backside. The fixed frame 632 is formed with the engaging devices (openings) 632*a*" that engage the engaging devices 622*a*" formed on the outer surface of the holding frame 613. The panel holding frame is formed so as to extend toward the storage frame 631, and the holding frame 631 is fixed to the panel storing frame 613 from the backside. The storage frame 631 abuts against the back surface of the panel holding frame 613 via a shock absorbing member 624, and is formed so as to extend toward the front surface. The storage frame 631 is provided with the engaging devices (openings) 631*a* that engage the engaging devices 613*a* formed on the outer surface of the holding frame 613.

The wiring member 610P composed of a flexible wiring board or the like is connected to the display unit 610, and is led to the outside of the panel holding frame 613 and the storage frame 631. The wiring member 620P is connected to the sound generating unit 620, and is led to the outside of the panel holding frame 613 and the storage frame 631.

In this embodiment, since the panel holding frame 613 also serves as the sound generating frame 122 in the first embodiment, the thickness of the electro-optical device 600 with a sound generating body can be reduced in comparison with the first embodiment.

Also, since the sound generating unit 620 is provided within the storage frame 631, an acoustic environment such as an air chamber can be established within the storage frame 631. Therefore, it is no longer necessary to provide an acoustic design outside the storage frame 631, for example, in the enclosure of the electronic apparatus to which the electro-optical device is installed, and hence stable sound generating property is achieved irrespective of the type of the electronic apparatus to which it is installed.

Also, since the sound generating body 621 is fixed to the storage frame 631 via the supporting member 623, a state which does not affect sound generation of the sound generating body 621 without depending on the structure of the display unit is achieved. Therefore, stable sound generating property is achieved even when the structure of the display unit is modified.

As described above, the modification has been described based on the seventh embodiment, the structure of this modification can be applied to the first embodiment to the sixth embodiment respectively, as a matter of course.

Eighth Embodiment

Lastly, referring to FIG. 8 and FIG. 9, an electronic apparatus on which the electro-optical device with a sound generating body described above is mounted will be described as a eighth embodiment. In this embodiment, an electronic apparatus provided with the electro-optical device 100 with a sound generating body as a display device will be described. However, other embodiments can also be applied to the present embodiment in the same manner as the electro-optical device 100 with a sound generating body.

Figure 8:
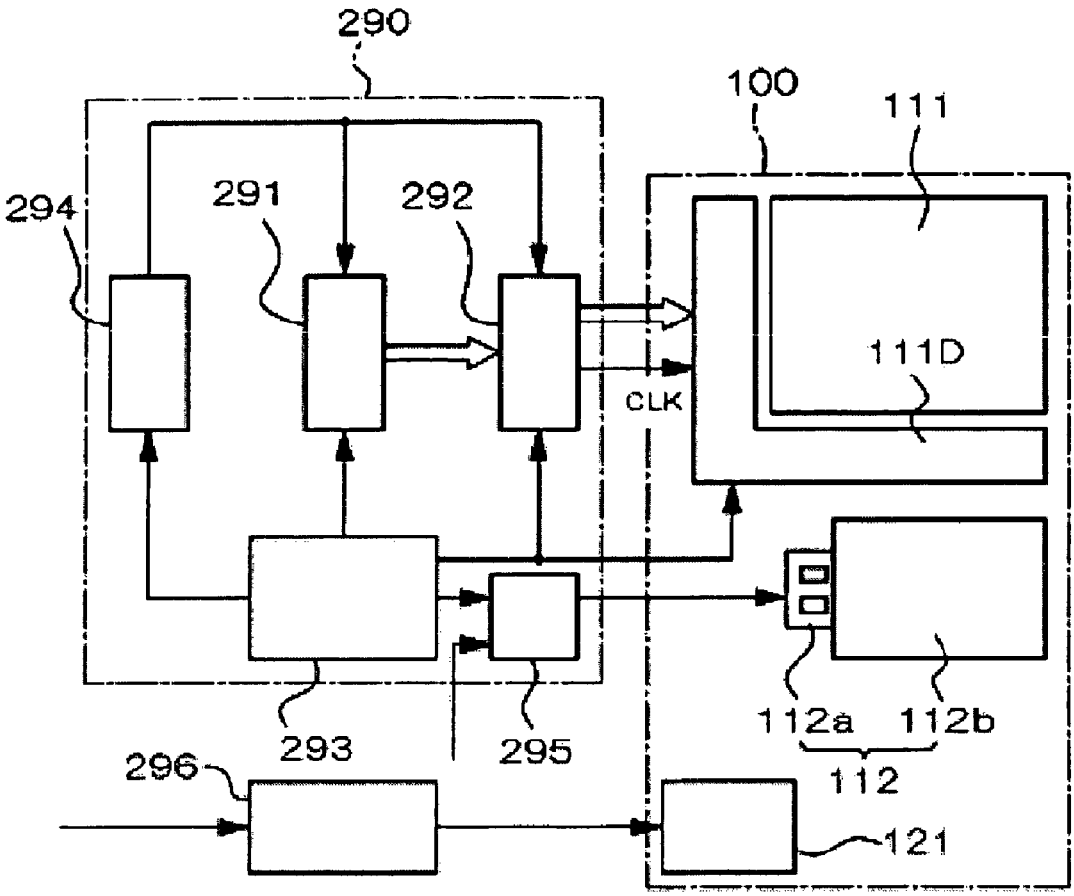
FIG. 8 is a schematic block diagram of an eighth embodiment.

FIG. 8 is a schematic block diagram showing a general structure of a control system (display control system) for the electro-optical device 100 with a sound generating body in the electronic apparatus according to the present embodiment. The electronic apparatus shown here includes a display control circuit 290 having a display information output source 291, a display information processing circuit 292, a power circuit 293, a timing generator 294, and a light source control circuit 295. In the electro-optical device 100 with a sound generating body as described above is provided with a drive circuit 111D for driving the electro-optical panel 111 having the above described structure. The drive circuit 111D includes electronic components (semiconductor IC, and so on) which are directly mounted on the electro-optical panel 111. However, in addition to the modes described above, the drive circuit 111D can be composed of a circuit pattern formed on the panel surface, a semiconductor IC chip or a circuit pattern mounted on a circuit board that is conductively connected to the liquid crystal panel, or the like.

The display information output source 291 includes a memory such as ROM (Read Only Memory) or RAM (Random Access Memory), a storage unit such as a magnetic recording disk or an optical recording disk, and a tuning circuit for synchronously output digital image signals, and is adapted to supply display information to the display information processing circuit 292 in the form of an image signal of a predetermined format or the like based on various clock signals generated by the timing generator 294.

The display information processing circuit 292 includes various known circuits such as a serial-parallel converting circuit, an amplifying and inverting circuit, a rotation circuit, a gamma correction circuit, a clamp circuit, and is adapted to execute processing of the supplied display information and supply the image information to the drive circuit 111D together with a clock signal CLK. The drive circuit 111D includes a scanning line drive circuit, a signal line drive circuit, and a detection circuit. The power circuit 293 supplies predetermined voltages respectively to the aforementioned components.

The light source control circuit 295 supplies power supplied from the power circuit 293 to a power source unit 112*a* of the back light 112 based on the control signal introduced from the outside. A light beam emitted from the light source unit 112*a* enters into a light guide plate 112*b*, and is irradiated from the light guide plate 112*b* to the electro-optical panel 111. The light source control circuit 295 controls ON and OFF of the respective light sources in the light source unit 112*a* according to the aforementioned control signal. It is also possible to control brightness of the respective light sources.

The electronic apparatus according to the present embodiment is provided with a sound signal output circuit 296. The sound signal output circuit 296 transmits the sound signal to the sound generating body 121 based on the control signal supplied from a control circuit, not shown. The sound generating body 121 outputs a sound based on the supplied sound signal.

Figure 9:
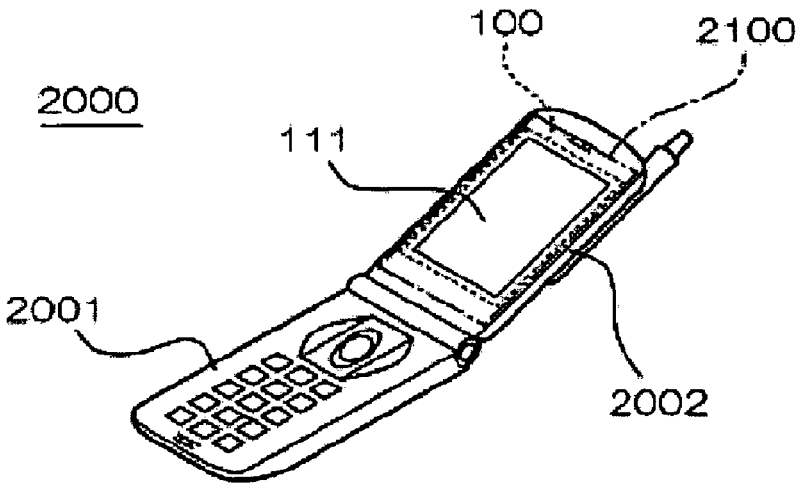
FIG. 9 is a schematic perspective view of the eighth embodiment.

FIG. 9 shows an appearance of a mobile phone as an embodiment of an electronic apparatus of the present invention. The electronic apparatus 2000 includes a final control element 2001 and a display unit 2002, and a circuit board 2100 is disposed in an enclosure of the display unit 2002. The electro-optical device 100 with a sound generating body is mounted on the circuit board 2100, and the surface of the display unit 2002 is adapted to visualize the liquid crystal panel 111. The display unit 2002 is provided with a sound output port 2003, and the sound output port 2003 is adapted so that the sound outputted from the sound generating body 121 and radiated from the sound releasing port described above via the interior of the enclosure of the display unit 2002 can be heard.

The electro-optical device with a sound generating body and the electronic apparatus of the present invention are not limited to the illustrated examples described above, and various modifications may be made without departing the scope of the present invention, as a matter of course. For example, although the storage frame is engaged and fixed to the display unit or the fixed frame by a hooking structure, the present invention is not limited to such a fixing state, and various fixing states such as press-fitting fixation, adhering fixation, or screw fixation may be employed.

What is claimed is:

1. An electro-optical device comprising:

a first frame;

a second frame opposed to the first frame;

a third frame interposed between the first frame and the second frame;

an electro-optical panel that is mounted directly to the first frame; and a sound generating body supported by the second frame and enclosed by the second frame and the third frame, the sound generating body being arranged so as to be completely two-dimensionally overlapped by the electro-optical panel in plan view.

2. An electro-optical device according to claim 1, the first frame being a panel holding frame that holds the electro-optical panel;

the third frame being a sound generating frame that defines an air chamber of the sound generating body; and the second frame being fixed to the first frame.

3. An electro-optical device according to claim 1, the sound generating body being a piezoelectric speaker.

4. An electronic apparatus comprising:

the electro-optical device according to claim 1; and a control device that controls the electro-optical device.

5. An electro-optical device according to claim 1, the second frame comprising a sound releasing port that releases sounds emitted from the sound generating body, the sound generating body being disposed between the electro-optical panel and the sound releasing port.

6. An electro-optical device comprising:

a first frame;

a second frame opposed to the first frame;

a third frame interposed between the first frame and the second frame;

an electro-optical panel supported by the first frame; and a sound generating body supported by the second frame and covered by the second frame and the third frame, the sound generating body being arranged so as to be two-dimensionally overlapped the electro-optical panel;

the first frame being a panel holding frame that holds the electro-optical panel;

the third frame being a sound generating frame that defines an air chamber of the sound generating body:

the second frame being fixed to the first frame;

the sound generating body being supported by the second frame via a supporting member and comprising a first surface on the side of the third frame and a second surface on the side of the second frame; and the supporting member separates a space between the first surface of the sound generating body and the third frame from a space between the second surface of the sound generating body and the second frame.

* * * * *